US007144000B2

(12) United States Patent
Roth et al.

(10) Patent No.: US 7,144,000 B2
(45) Date of Patent: Dec. 5, 2006

(54) AUTOMATIC CHOKE FOR AN ENGINE

(75) Inventors: David Roth, North Fond du Lac, WI (US); James J. Dehn, Brookfield, WI (US); Thomas G. Guntly, Hartford, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 11/141,657

(22) Filed: May 31, 2005

(65) Prior Publication Data

US 2006/0043621 A1 Mar. 2, 2006

Related U.S. Application Data

(63) Continuation-in-part of application No. 10/925,111, filed on Aug. 24, 2004, now abandoned.

(51) Int. Cl.
*F02M 1/10* (2006.01)

(52) U.S. Cl. ..... 261/39.3; 123/437; 123/676; 261/39.4; 261/52

(58) Field of Classification Search ..... 261/52, 261/39.3, 39.4, 39.1; 123/676, 437
See application file for complete search history.

(56) References Cited

U.S. PATENT DOCUMENTS

| | | | | |
|---|---|---|---|---|
| 2,160,411 | A | | 5/1939 | Blattner et al. |
| 2,836,404 | A | | 5/1958 | Carlson et al. |
| 2,885,194 | A | * | 5/1959 | Winkler ..... 261/52 |
| 2,982,275 | A | | 5/1961 | Doman et al. |
| 3,272,486 | A | * | 9/1966 | Lucas et al. ..... 261/39.3 |
| 3,625,492 | A | | 12/1971 | Reichenbach et al. |
| 3,740,040 | A | | 6/1973 | Brown, III et al. |
| 3,807,709 | A | | 4/1974 | Suda et al. |
| 3,862,278 | A | | 1/1975 | Nakada |
| 3,886,917 | A | | 6/1975 | Nakada et al. |
| 4,113,808 | A | | 9/1978 | Hackbarth et al. |
| 4,123,480 | A | | 10/1978 | Johansson |
| 4,132,751 | A | | 1/1979 | Winkley |
| 4,137,283 | A | | 1/1979 | Couderc |
| 4,176,648 | A | | 12/1979 | Gotoh et al. |
| 4,192,834 | A | | 3/1980 | Berkbigler |
| 4,200,595 | A | * | 4/1980 | Dye ..... 261/39.3 |
| 4,307,042 | A | * | 12/1981 | Berich ..... 261/52 |
| 4,391,249 | A | | 7/1983 | Bianchi et al. |
| 4,439,377 | A | | 3/1984 | Nartowski |
| 4,983,330 | A | * | 1/1991 | Harbeke ..... 261/52 |
| 5,069,180 | A | | 12/1991 | Schmidt et al. |
| 5,200,118 | A | | 4/1993 | Hermle |

(Continued)

FOREIGN PATENT DOCUMENTS

| | | |
|---|---|---|
| EP | 0 348 706 | 1/1990 |

(Continued)

*Primary Examiner*—Richard L. Chiesa
(74) *Attorney, Agent, or Firm*—Michael Best & Friedrich LLP

(57) ABSTRACT

An internal combustion engine including a carburetor. The internal combustion engine includes a choke valve disposed within the carburetor, and a choke lever interconnected with the choke valve for movement with the choke valve. The engine also includes a throttle valve disposed within the carburetor and a throttle lever interconnected with the throttle valve for movement therewith. An intermediate lever is disposed between the throttle lever and the choke lever for movement with the choke and throttle levers. In one embodiment, the engine includes a connecting link coupled between the choke and intermediate levers, the connecting link movable with movement of the choke lever such that movement of the choke lever is translated into movement of the intermediate lever.

29 Claims, 13 Drawing Sheets

U.S. PATENT DOCUMENTS

| | | | | |
|---|---|---|---|---|
| 5,500,159 | A | 3/1996 | Martinsson | |
| 5,611,312 | A | 3/1997 | Swanson et al. | |
| 6,000,683 | A | 12/1999 | Van Allen | |
| 6,202,989 | B1 | 3/2001 | Pattullo | |
| 6,439,547 | B1 | 8/2002 | King et al. | |
| 6,641,118 | B1 | 11/2003 | Schliemann | |
| 6,990,969 | B1 * | 1/2006 | Roth et al. | 123/676 |
| 2002/0121710 | A1 | 9/2002 | King et al. | |
| 2003/0052422 | A1 | 3/2003 | Schliemann | |
| 2004/0065965 | A1 * | 4/2004 | Warfel et al. | 261/52 |

FOREIGN PATENT DOCUMENTS

| | | | | |
|---|---|---|---|---|
| EP | 1 424 487 | | 6/2004 | |
| JP | 54 101021 | | 8/1979 | |
| JP | 55-119930 | * | 9/1980 | 261/52 |
| JP | 04 311657 | | 11/1992 | |

* cited by examiner

AUTOMATIC CHOKE FOR AN ENGINE

RELATED APPLICATIONS

This application is a continuation-in-part of U.S. patent application Ser. No. 10/925,111, filed Aug. 24, 2004, now abandoned, the entire contents of which is incorporated by reference herein.

FIELD OF THE INVENTION

This invention relates to choke assemblies for an internal combustion engine. More specifically, the invention relates to an automatic choke assembly having engagement between the choke and throttle.

BACKGROUND OF THE INVENTION

In small internal combustion engines utilizing a carburetor, such as those engines in a lawnmower, a snowblower, or other outdoor power equipment, the engines typically include a choke assembly that provides a rich fuel-air mixture in the intake manifold upon start-up of the engine to sustain the combustion reaction, and a throttle assembly responsive to the speed of the engine and the load on the engine. In many small engines, the choke assembly is actuated manually.

In engines having an automatic choke assembly, such as those where the choke opening is controlled by a thermally responsive mechanism or where a self-relieving choke is utilized, fluctuating air pressure within the carburetor can cause a choke valve in the choke assembly to flutter after the choke has opened. While in certain engine operating conditions some amount of flutter may be desired, uncontrolled flutter in automatic choke devices can adversely affect the operation of the engine, such as by causing engine surging and increased component wear and fatigue within the engine.

SUMMARY OF THE INVENTION

The present invention provides an internal combustion engine including a carburetor. The engine also includes a choke valve disposed within the carburetor and a choke lever coupled to the choke valve for movement therewith. The choke valve is movable between an open position and a closed position, and the throttle valve is movable between a wide open throttle position, a high speed no load position, and an idle position. The engine also includes an intermediate lever coupled between the throttle lever and the choke lever for movement with the throttle and choke levers. In one embodiment, the intermediate lever includes a slot for sliding engagement with one of the choke and throttle levers.

In one embodiment, the engine further includes a thermally conductive assembly operable to hold the choke open during warm-engine restarts, the thermally conductive assembly including a mechanism that moves in response to the engine temperature sensed by the thermally conductive assembly.

In another embodiment, the slot includes an enlarged portion to allow the choke valve to flutter within the carburetor. In yet another embodiment, varying the parameters of the intermediate lever, including the length or width of the slot, calibrates operating characteristics within the engine.

The invention also provides for a carburetor having a choke valve and a choke lever coupled for movement therewith, as well as a throttle valve and a throttle lever coupled for movement therewith. The carburetor further includes an intermediate lever coupled to the choke lever via a connecting link. The connecting link translates motion of the choke lever into motion of the intermediate lever.

In one embodiment, the intermediate lever also includes a throttle engagement surface that engages a projection on the throttle lever during operation of the carburetor. At least one of the shape and position of the throttle engagement surface can be varied, which changes operating characteristics of the engine.

In another embodiment, the engine further comprises a thermally conductive assembly operable to hold the choke open during warm-engine restarts, the thermally conductive assembly including a mechanism that moves in response to the engine temperature sensed by the thermally conductive assembly. The mechanism is coupled to a choke retaining lever that is rotatable with movement of the mechanism to hold the choke open.

Further constructions and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show some embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION

Figure 1:
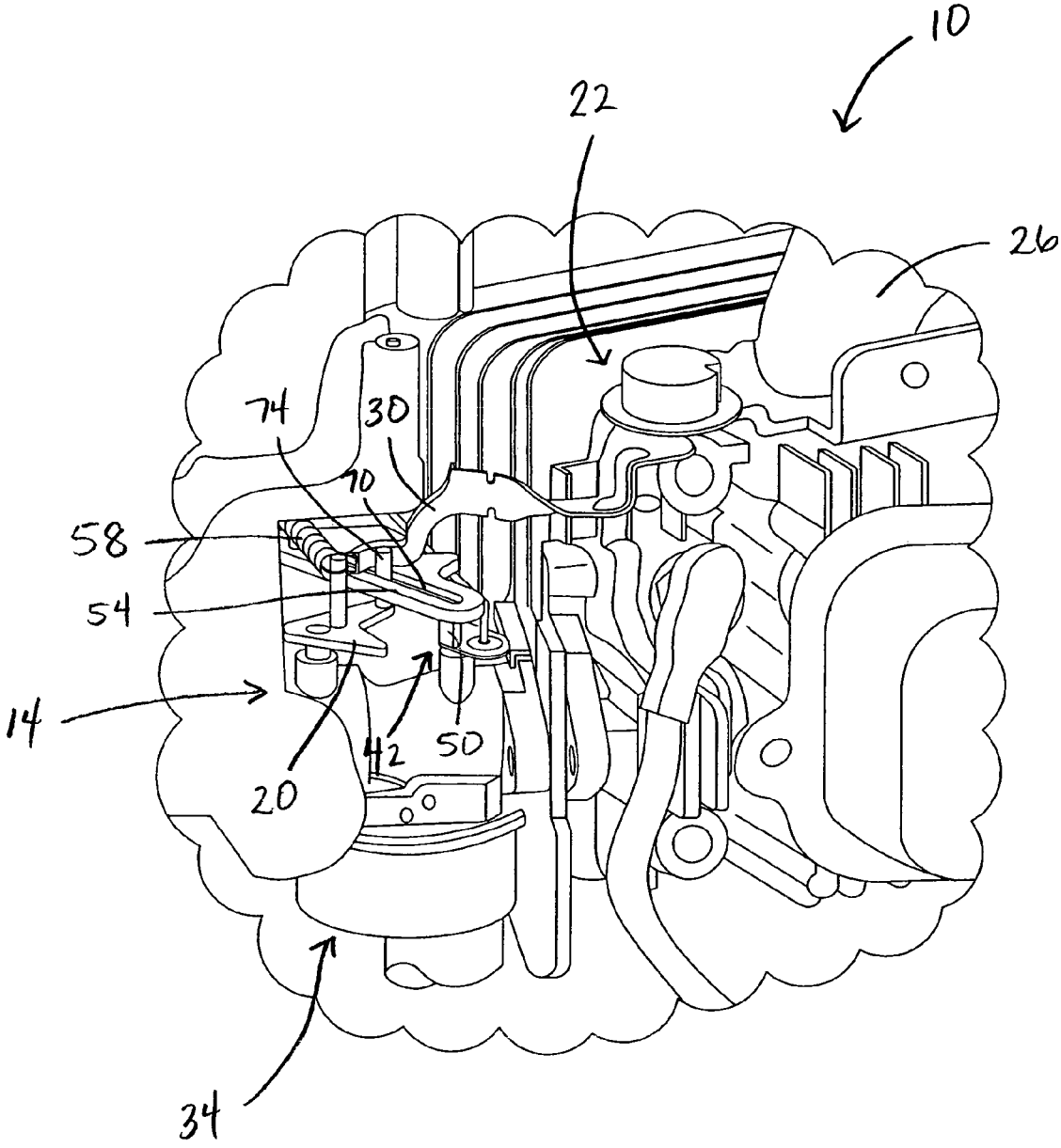
FIG. 1 is a partial perspective view of an internal combustion engine including one embodiment of a carburetor embodying the present invention, illustrating the choke assembly of the carburetor in the closed position.
Figure 2:
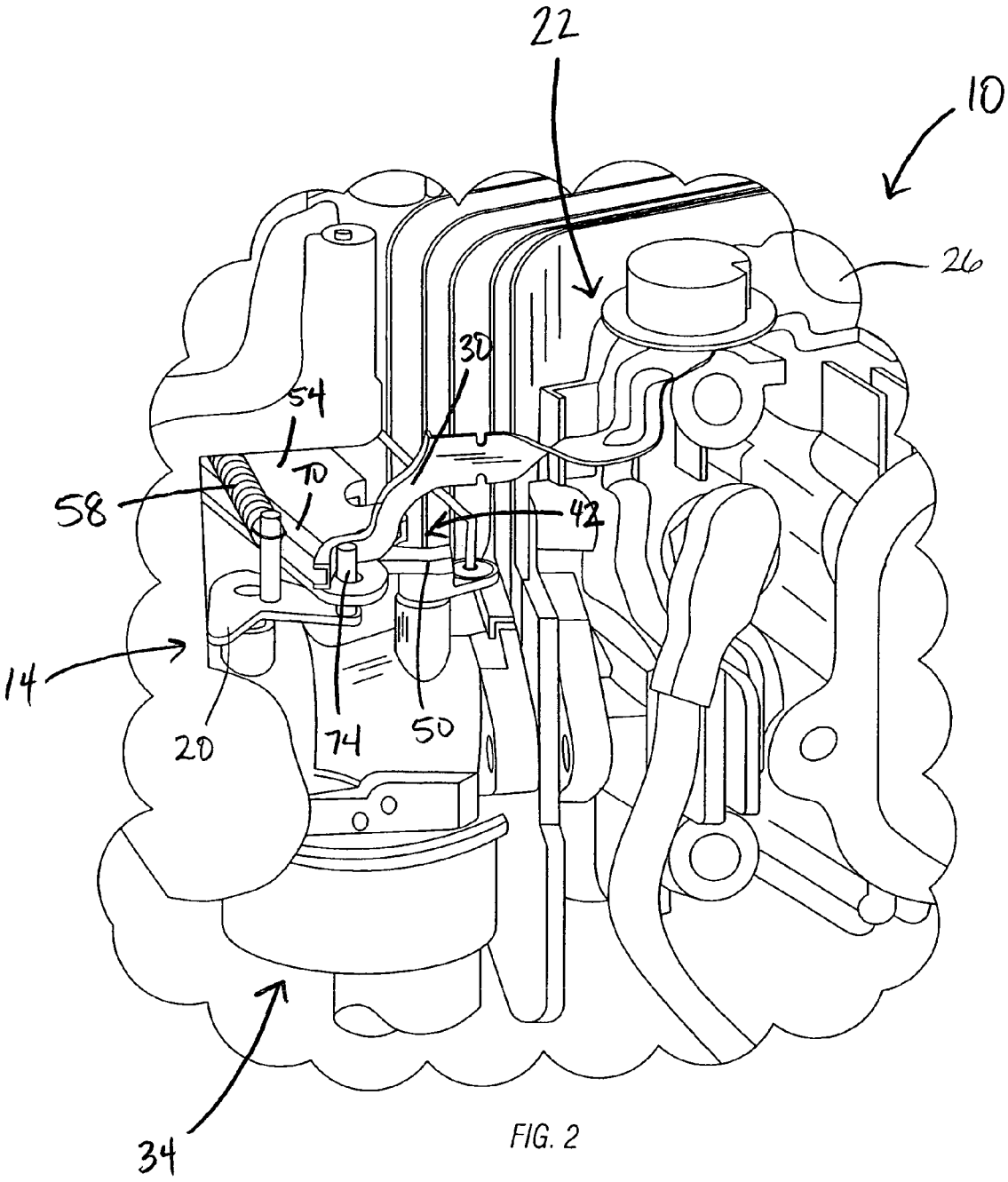
FIG. 2 is a partial perspective view of the internal combustion engine of FIG. 1, illustrating the choke assembly in the open position.

FIGS. 1 and 2 illustrate an internal combustion engine 10 according to one embodiment of the present invention. The engine 10 includes a choke assembly 14 that pivots about a choke pivot point 16 and includes a choke valve 18 (shown in FIGS. 3 and 4) and a choke operating device. The choke assembly 14 also includes a choke lever 20 that is coupled to the choke valve 18 for movement therewith (about the choke pivot point 16). The choke valve 18 will be described in more detail below with respect to FIG. 4.

In the closed position, the choke valve 18 restricts air flow into the engine, increasing the amount of fuel delivered to the engine 10 during engine starting to ensure that the combustion reaction within the engine 10 is sustained when the engine 10 is cold. As the engine 10 warms up, the enriched fuel-air mixture is no longer needed and the choke valve 18 rotates open, allowing more air into the engine 10.

The engine 10 also includes a thermally conductive assembly 22 and an engine muffler (not shown) attached to the exhaust manifold 26 of the engine 10. The thermally conductive assembly 22 is in communication with the exhaust gases produced by the engine 10 to allow the thermally conductive assembly 22 to conduct heat from the exhaust gases, indicating the temperature in the engine 10. The thermally conductive assembly 22 includes a mechanism 30 that moves in response to the engine temperature. The mechanism 30 contacts the choke assembly 14, as will be discussed in more detail below, to hold the choke valve 18 open during warm engine restarts and during warm engine operating conditions to prevent an overly-rich fuel-air mixture from causing the engine 10 to sputter, stall, or produce excess emissions. The details of one suitable thermally conductive assembly 22 are described in pending U.S. patent application Ser. No. 10/784,542, filed Feb. 23, 2004, now U.S. Pat. No. 6,990,969, the entire contents of which are incorporated by reference herein. The interaction of the thermally conductive assembly 22 with the choke assembly 14 allows the choke assembly 14 to function as an automatic choke.

Figure 3:
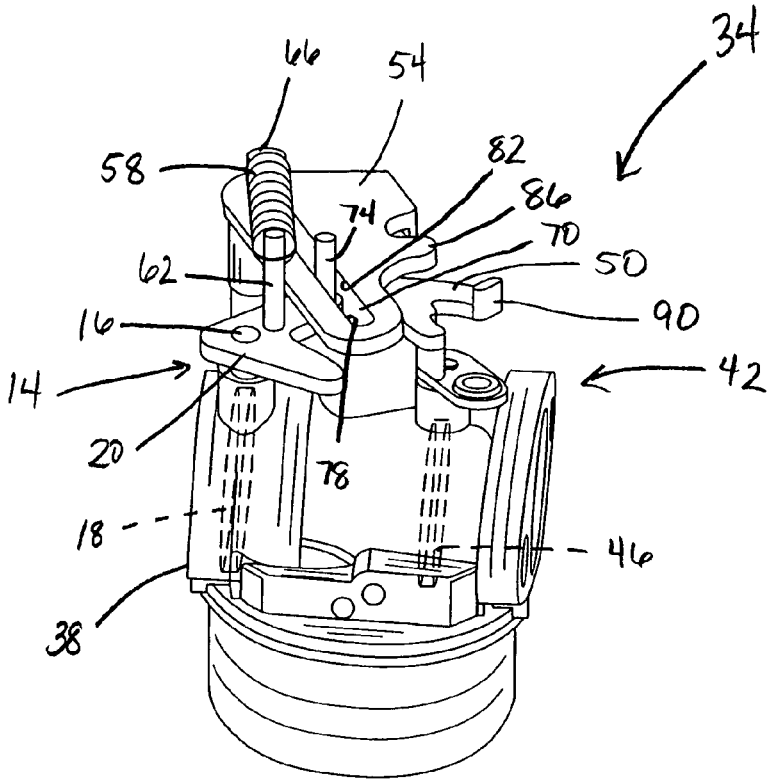
FIG. 3 is a perspective view of the carburetor of FIG. 1, illustrating the choke assembly in the closed position and the throttle assembly in the wide open throttle position.
Figure 4:
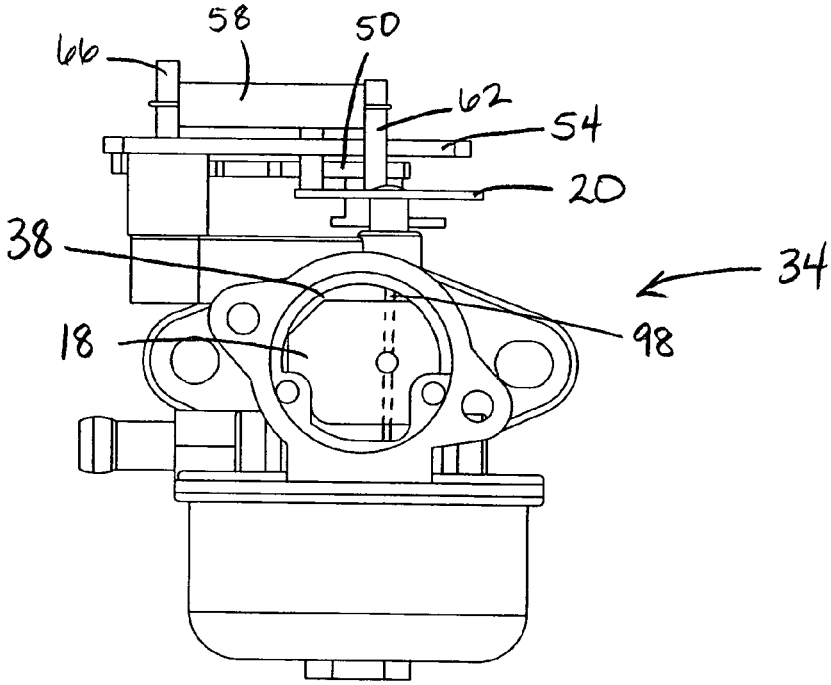
FIG. 4 is a side view of the carburetor of FIG. 1, illustrating the choke valve in detail.

Referring now to FIG. 3, the engine 10 also includes a carburetor 34. The carburetor 34 includes an air intake passage 38, having the choke valve 18 rotatably mounted therein. The carburetor 34 also includes a throttle assembly 42, the throttle assembly 42 including a throttle valve 46 rotatably mounted within the carburetor 34, and a throttle lever 50 coupled to the throttle valve 46. The throttle lever 50 is coupled for rotation with the throttle valve 46.

The carburetor 34 also includes an intermediate lever 54 disposed between the choke lever 20 and throttle lever 50 for movement with the levers 20 and 50. The intermediate lever 54 allows for interaction between the choke lever 20 and throttle lever 50 during engine operation to hold the choke valve 18 in at least a partially open position when the throttle assembly 42 is in the high speed no load position to prevent excess fluttering of the choke valve 18. The configuration of the intermediate lever 54 controls the rate of choke opening and controls the force of interaction with the throttle to control the speed rise in the engine. The various parameters of the intermediate lever 54 that can be adjusted to calibrate operating conditions within the engine 10 will be discussed in greater detail below.

A biasing member, shown in the illustrated embodiment as a spring 58, is coupled to a spring shaft 62 on the choke lever 20 at one end, and is coupled to a spring anchor shaft 66 on the intermediate lever 54 on the other end. The spring 58 biases the choke valve 18 in the closed position upon engine starting, and also functions to bias the choke valve 18 in the open position after the engine has warmed up.

In the embodiments illustrated in FIGS. 1–10, the intermediate lever 54 includes a slot 70 therethrough. A post 74 coupled to the choke lever 20 moves within the slot 70 such that movement of the choke lever 20 causes some movement of the intermediate lever 54. The slot 70 includes a first surface 78 and a second surface 82. As the choke valve 18 moves from the closed to the open position, the post 74 engages the first surface 78, moving the intermediate lever 54 with it. As the choke valve 18 moves from open to closed, the post 74 engages the second surface 82 of the slot 70.

Figure 5:
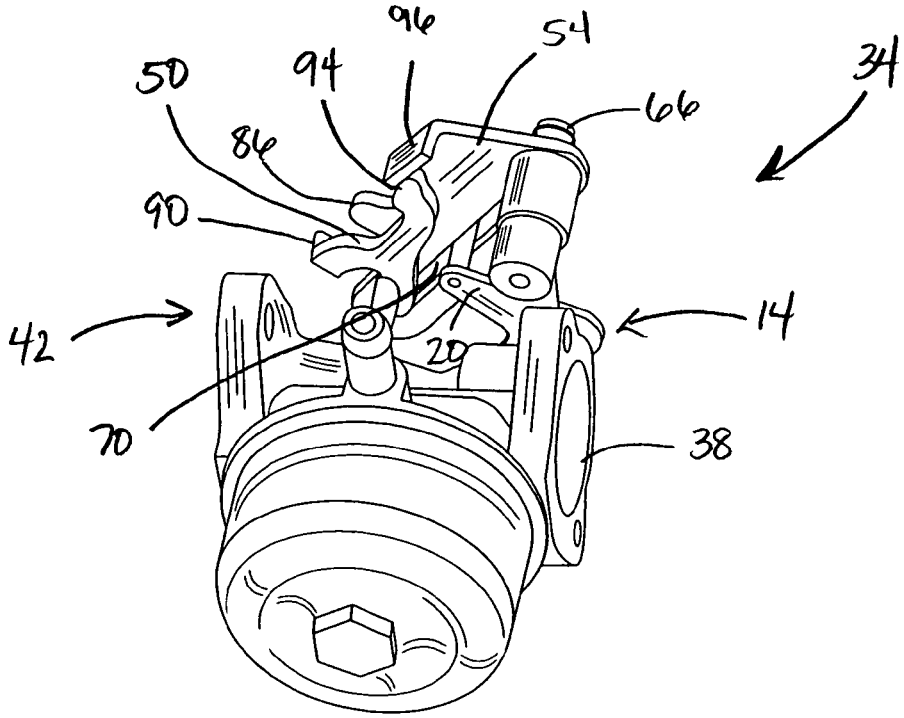
FIG. 5 is a bottom perspective view of the carburetor of FIG. 3.
Figure 6:
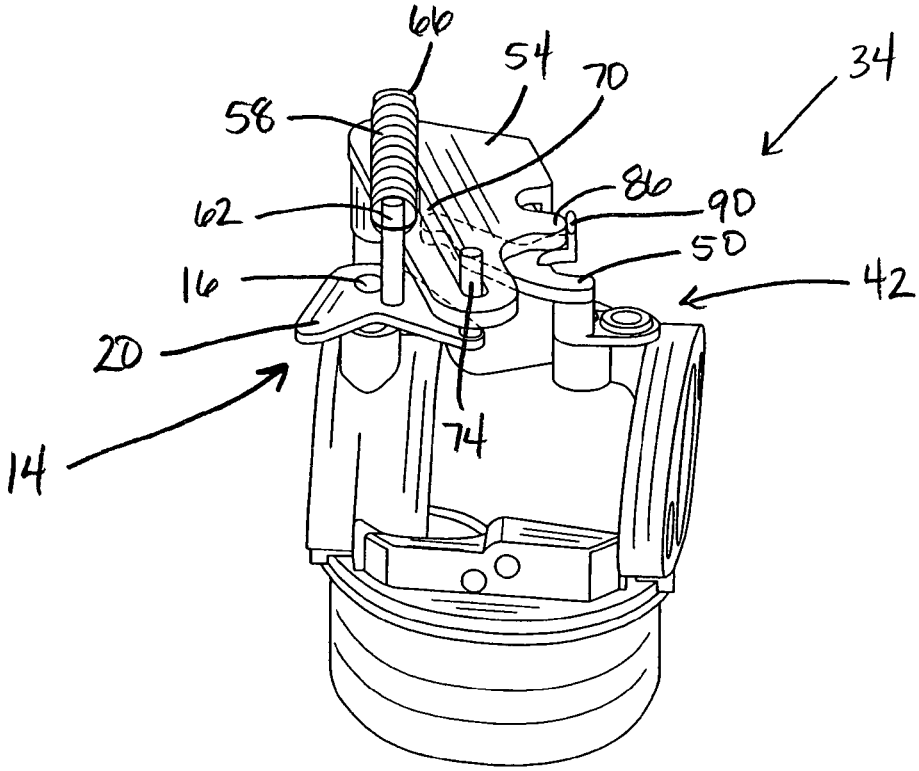
FIG. 6 is a perspective view of the carburetor of FIG. 1, illustrating the choke assembly in the open position and the throttle assembly in the high speed no load position.
Figure 7:
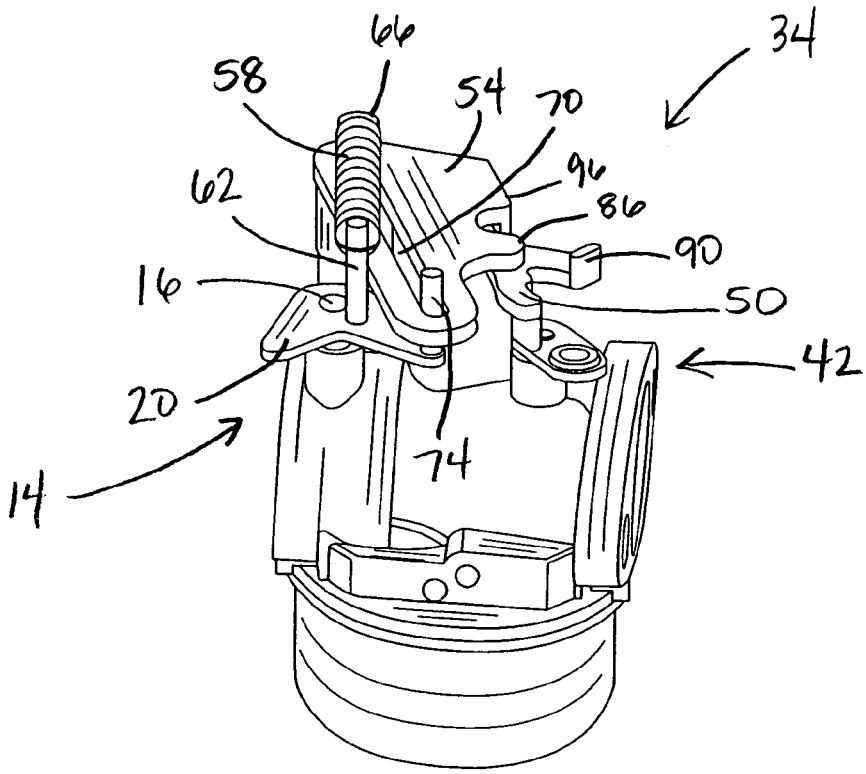
FIG. 7 is a perspective view of the carburetor of FIG. 1, illustrating the choke assembly in the open position and the throttle assembly in the wide open throttle position.

As best shown in FIGS. 3–10, the intermediate lever 54 also includes a tang 86. Depending on the operating condition, a first protrusion 90 on the throttle lever 50 engages the tang 86 during engine operation. A second protrusion 94 on the throttle lever 50 engages the inside of a lip 96 on the intermediate lever 54. As shown in FIG. 5, the second protrusion 94 engages the lip 96 when the throttle assembly 42 is in the wide open throttle position. In the wide open throttle position, the lip 96 acts as a throttle stop, preventing overrotation of the throttle valve 46. As shown in FIG. 6, the first protrusion 90 engages the tang 86 in the high speed no load throttle position. As the throttle lever 50 engages the intermediate lever 54 as the throttle lever 50 moves from the wide open throttle position to the high speed no load position, the throttle lever 50 exerts a force on the intermediate lever 54 that counteracts the biasing force of the spring 58.

Many parameters of the intermediate lever 54 can be varied to calibrate or change the operating characteristics within the engine for different application requirements. For example, the shape and position of the tang 86 and lip 96 on the intermediate lever 54, and the shape and position of the first and second protrusions on the throttle lever 50, affects the force between the intermediate lever 54 and the throttle lever 50 (by changing the angle of the force). This force, in turn, controls the speed rise and droop within the engine. In another example, making the slot 70 in the intermediate lever 54 wider allows for more flutter of the choke valve 18, which in turn enriches the fuel-air mixture. Adjusting the width of the slot 70 allows for control of the amount of flutter (providing the desired enrichment during warm-up, but not allowing so much flutter that there are problems with engine surging and engine wear). By controlling these parameters, the engine speed rise during the engine warm-up period can be calibrated (for example, providing more speed rise during cold engine starts), enrichment of the fuel-air mixture during engine starting can be achieved, and the reduced choke flutter results in better reliability of the engine, reduced engine wear, and a wider range of usable spring return.

Referring back to FIG. 4, the choke valve 18 rotates about a choke shaft 98. The choke valve 18 of the illustrated embodiment is a self-relieving choke, with the choke shaft 98 being offset from the center of the choke valve 18. The more off-center the choke valve 18 is, the greater the amount of torque is generated on the valve due to the air pressure within the engine. The higher torque makes it easier to overcome the spring biasing force that holds the choke valve 18 in the closed position. It should be understood that while in the illustrated embodiment, the choke is self-relieving due to the off-center choke shaft 98, other types of self-relieving chokes can be used and still fall within the scope of the present invention. Other types of self-relieving chokes may include a choke assembly having a two-piece choke plate such that one piece of the plate pivots on the shaft, a choke valve on a central choke shaft having relief holes therethrough, a choke valve where some or all of the relief holes include a mushroom or poppet valve therein that is opened by the suction within the carburetor, and other known self-relieving choke assemblies.

At engine start-up, the choke valve 18 is in the closed position and the throttle valve 46 is in the wide open throttle position. The influx of air through the intake passage 38 and warm-up of the engine cause the choke valve 18 to move to the open position. The rotation of the choke lever 20 causes the post 74 to slidably engage the intermediate lever 54 within the slot 70, causing rotation of the intermediate lever 54. In circumstances where the engine 10 is already warm upon start-up, the mechanism 30 of the thermally conductive assembly 22 functions to hold the choke valve 18 in at least a partially open position to prevent an overly-rich fuel-air mixture when the engine 10 does not require such a rich mixture to maintain combustion. The mechanism 30 contacts the post 74 on the choke lever 20 to hold the choke open. In the wide open throttle position, the second protrusion 94 engages the lip 96 of the intermediate lever 54.

After the engine starts, the throttle valve 46 moves from the wide open throttle position to the high speed no load position, best shown in FIG. 6. In the high speed no load position, the first protrusion 90 on the throttle lever 50 engages the tang 86 on the intermediate lever 54, preventing flutter of the intermediate lever 54. As a load is applied to the engine 10, the throttle valve 46, and thus the throttle lever 50, rotate back toward the wide open throttle position, best shown in FIG. 7.

Figure 8:
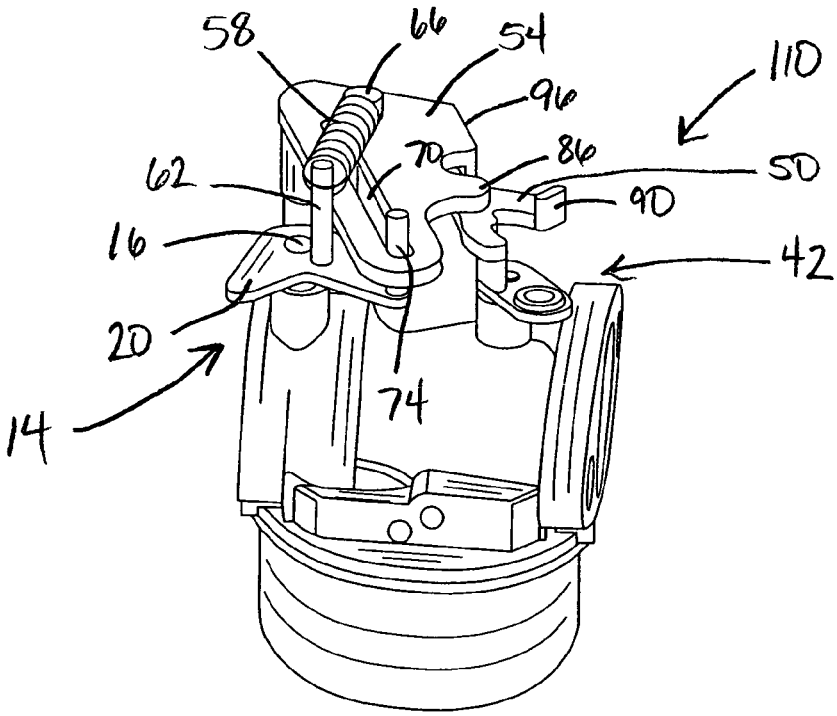
FIG. 8 is a perspective view of a carburetor according to another embodiment of the present invention.
Figure 9:
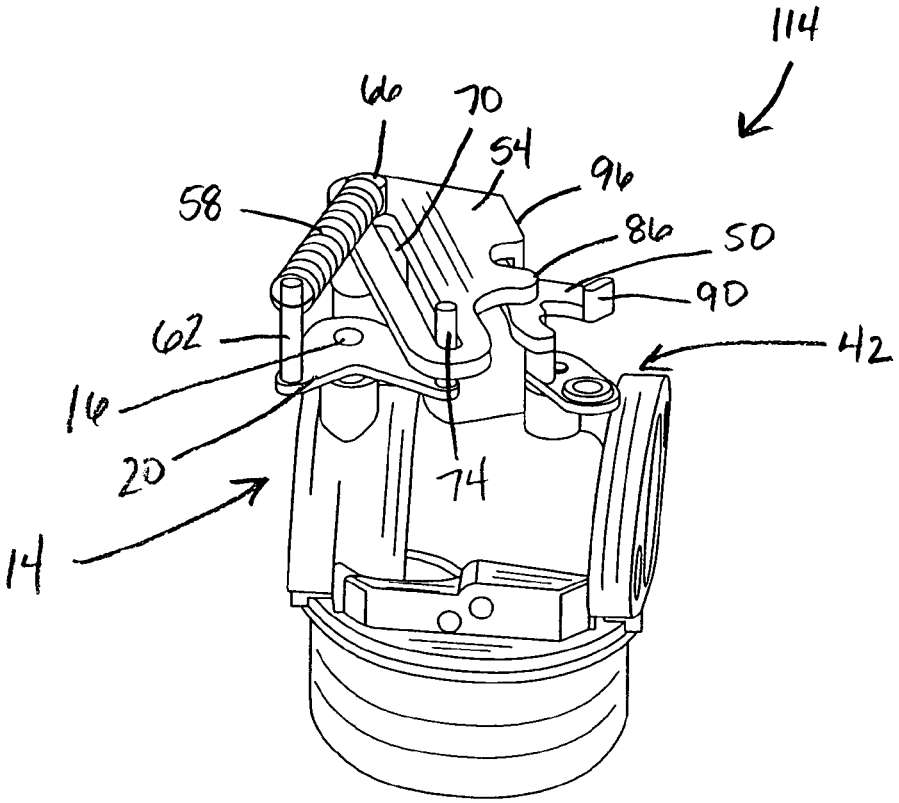
FIG. 9 is a perspective view of a carburetor according to another embodiment of the present invention.

FIGS. 8 and 9 illustrate other carburetors 110, 114 embodying aspects of the present invention. In operation, the carburetors 110, 114 are similar to the carburetor 34 described in detail above. With reference to FIG. 8, the location of the spring anchor shaft 66 has been moved away from the pivot point, toward the middle of the intermediate lever 54. In the embodiment of FIG. 9, the spring shaft 62 has been moved away from the choke pivot point 16. By adjusting the position of either the spring anchor shaft 66 or spring shaft 62, the effective spring rate of the spring 58 is changed. Changing the spring rate changes the amount of droop within the engine. In some applications, such as when the carburetor is used in a generator, less droop is desired to keep the speed of the engine tighter and thus a lower effective spring rate is desired.

For example, moving the position of the spring anchor shaft 66 as in FIG. 8 results in a lower effective spring rate by giving a lower force when the choke valve 18 opens. The rotation of the intermediate lever 54 to the choke open position relaxes the spring, resulting in less flutter of the choke valve 18 since there is less force biasing the choke valve 18 in the closed position.

Figure 10:
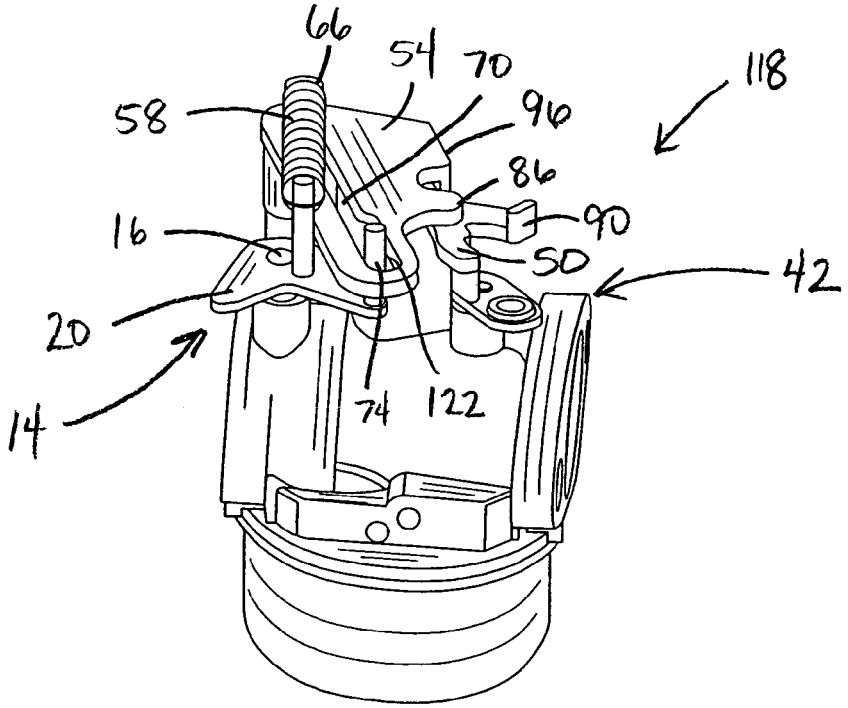
FIG. 10 is a perspective view of a carburetor according to yet another embodiment of the present invention.

FIG. 10 illustrates another carburetor 118 embodying aspects of the present invention. As illustrated in FIG. 10, the slot 70 in the intermediate lever 54 includes an enlarged portion 122. The enlarged portion 122 creates a warm-up position in which the choke lever 20 (and thus the choke valve 18) rests with the choke valve 18 partially closed. This enriches the fuel-air ratio in the carburetor during engine warm-up, especially during cold engine starts. The size and configuration of the enlarged area 122 is carefully calculated to control the amount of fuel enrichment.

Figure 11:
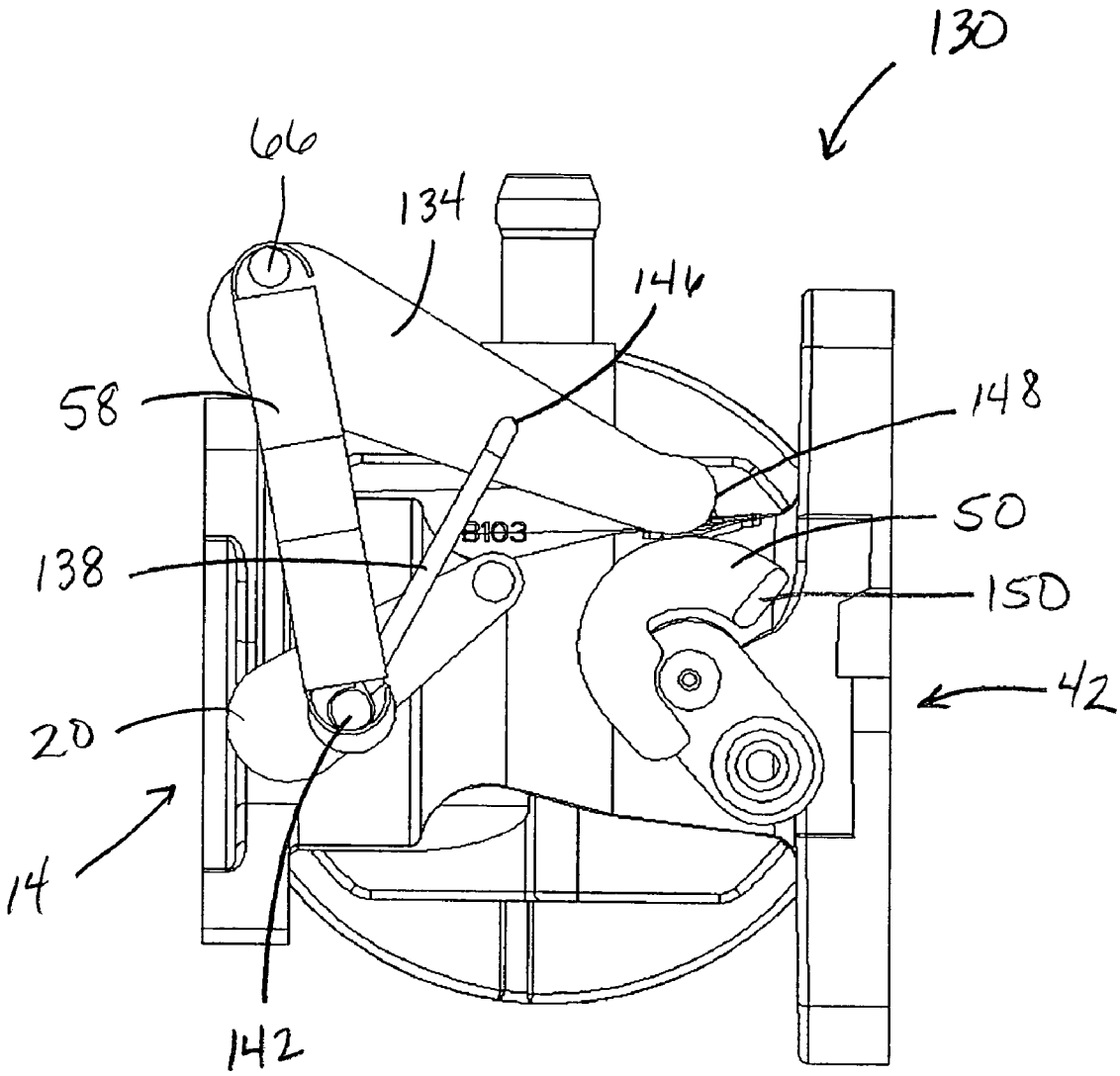
FIG. 11 is a top view of another carburetor according to one embodiment of the present invention, illustrating the choke assembly in the closed position and the throttle assembly in the wide open throttle position.
Figure 12:
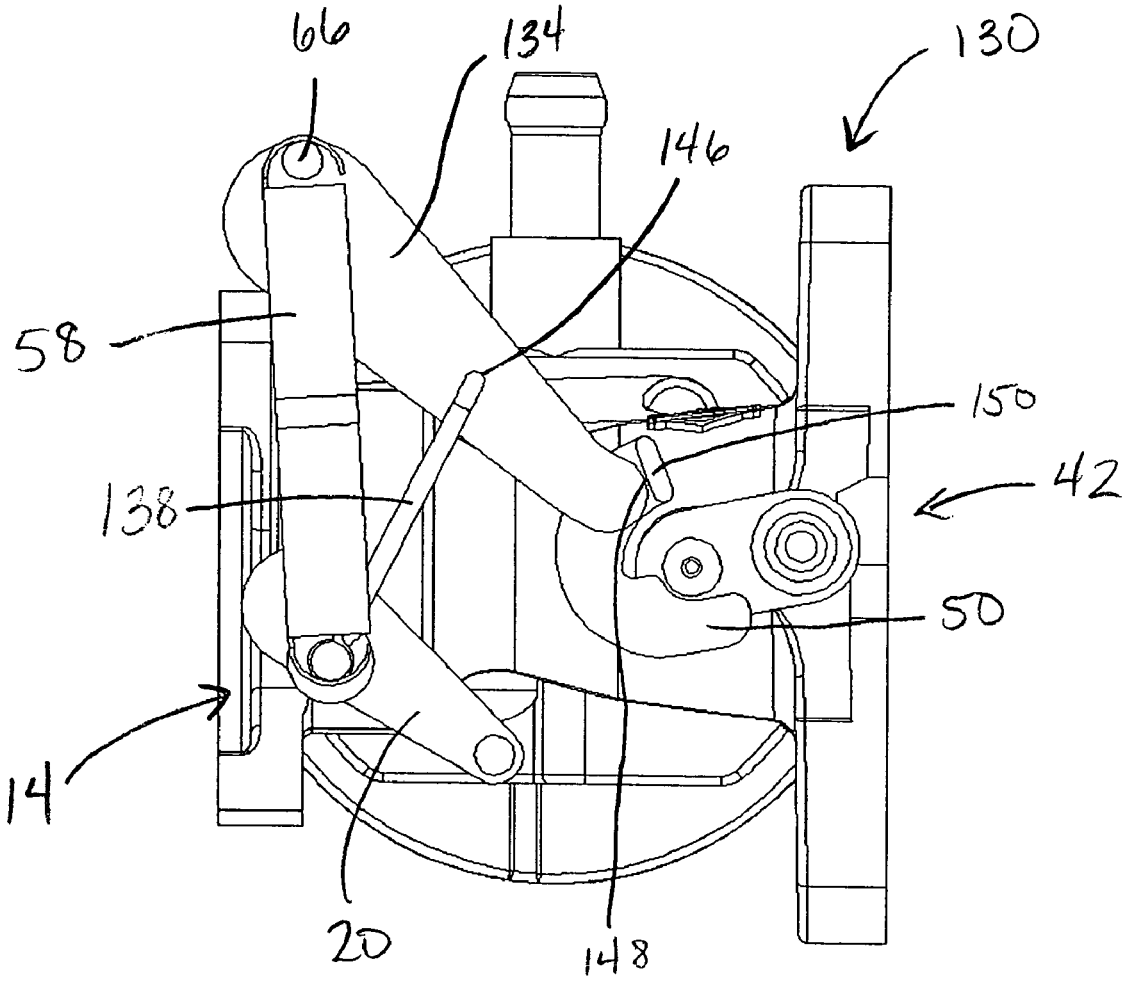
FIG. 12 is a top view of the carburetor of FIG. 1, illustrating the choke assembly in the open position and the throttle assembly in the high speed no load position.

FIGS. 11 and 12 illustrate yet another carburetor 130 embodying aspects of the present invention. As illustrated in FIG. 11, the choke lever 20 is coupled to an intermediate lever 134 via a connecting link 138. The connecting link 138 is coupled to a connecting post 142 on the choke lever 20 for movement therewith. The connecting link 138 is coupled at the other end to the intermediate lever 134 through an aperture 146. The positions of the connecting post 142 and the aperture 146 are variable. Varying either of the positions of the connecting post 142 and the aperture 146 calibrate operating characteristics within the engine, such as changing the effective spring rate.

Movement of the choke lever 20 is translated into movement of the intermediate lever 134 through the connecting link 138. In the illustrated embodiment, there is a four to one ratio of movement between the choke lever 20 and intermediate lever 134 such that for every four degrees of movement of the choke lever 20, the intermediate lever 134 moves one degree.

The spring 58 is also coupled to the connecting post 142 on the choke lever 20 on one end, and is connected to the spring anchor post 66 on the intermediate lever 134 on the other end. The intermediate lever 134 also includes a throttle engagement surface 148 that engages a projection 150 on the throttle lever 50 as the throttle lever 50 rotates toward the high speed no load position. The shape and position of the throttle engagement surface 148 and the projection 150 can be varied, which also calibrates operating characteristics within the engine, such as changing the angle of the force applied (as discussed in detail above).

Figure 13:
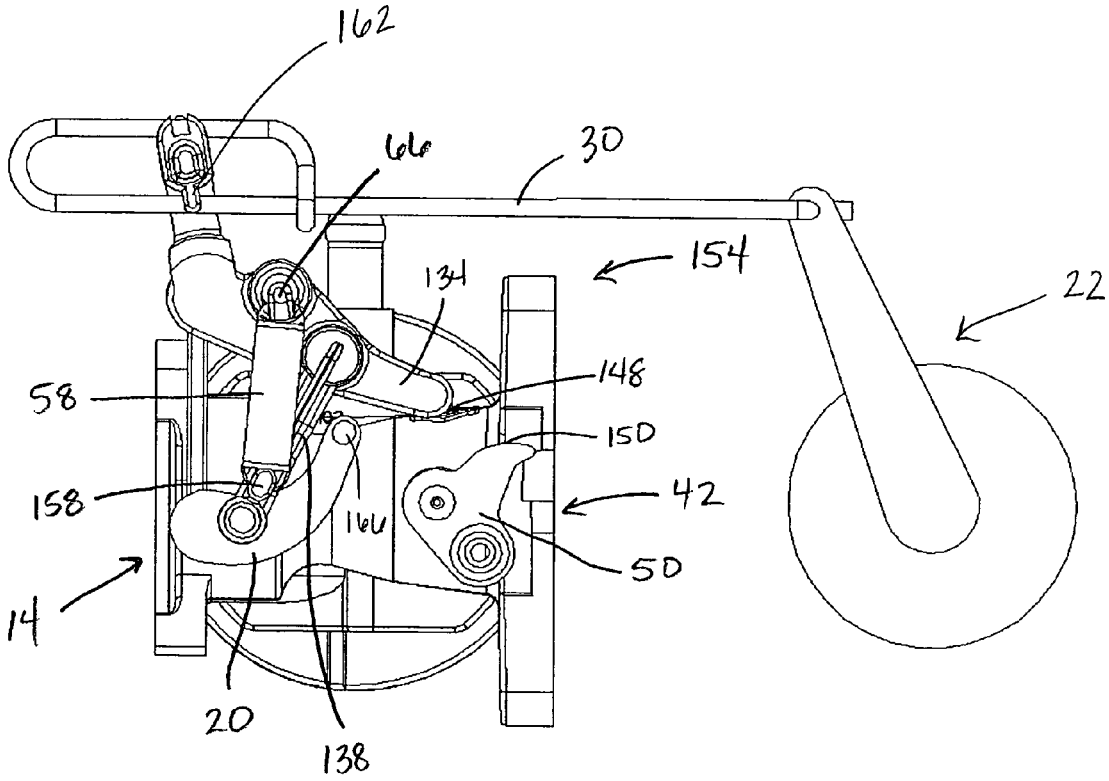
FIG. 13 is a top view of another carburetor according to one embodiment of the present invention, illustrating the choke assembly in the closed position and the throttle assembly in the wide open throttle position.
Figure 14:
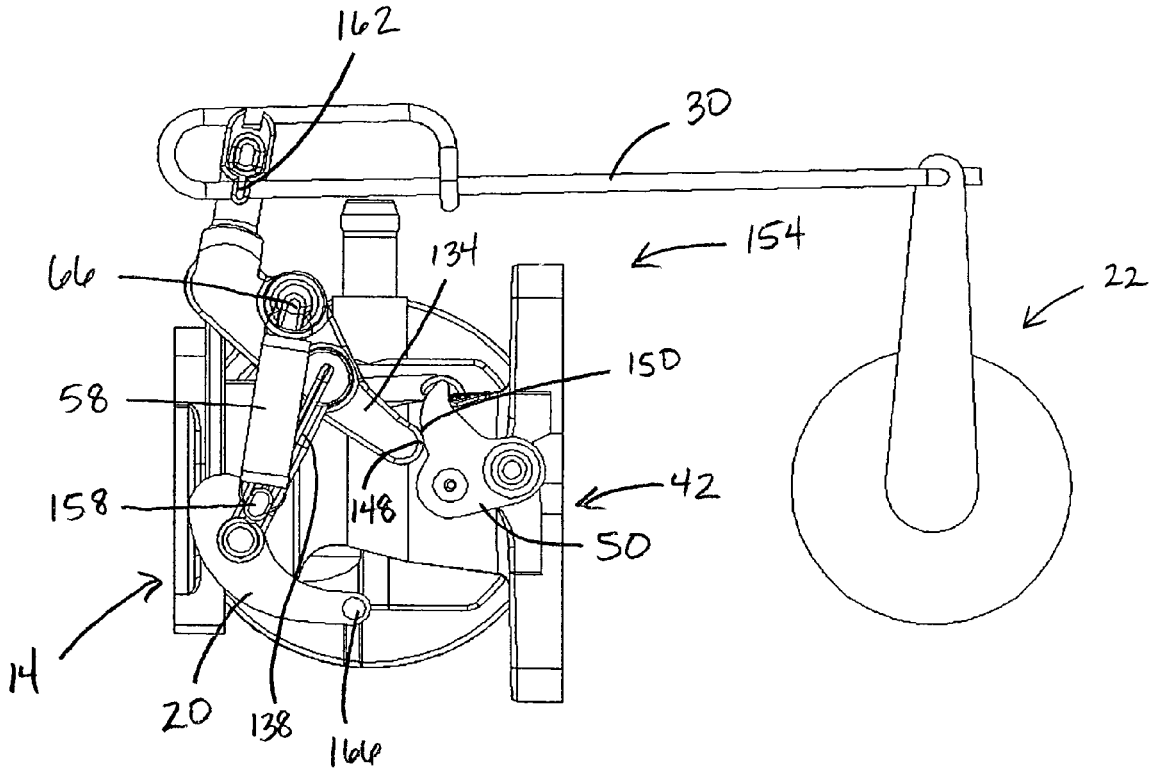
FIG. 14 is a top view of the carburetor of FIG. 13, illustrating the choke assembly in the open position and the throttle assembly in the high speed no load position.

FIGS. 13 and 14 illustrate another carburetor 154 embodying aspects of the present invention. In operation, the carburetor 154 is similar to the carburetor 130 discussed above. However, as illustrated in FIGS. 13 and 14, the spring 58 is coupled at one end to a post 158 on the connecting link 138, rather than being coupled to the choke lever 20 directly. Moving the spring connection point from the choke lever 20 to the connecting link 138 makes for a more constant effective spring rate, lowering the slope of the spring force curve.

As further illustrated in FIGS. 13 and 14, the mechanism 30 of the thermally responsive assembly 22 contacts the intermediate lever 134 to hold the choke open during warm engine restarts. The mechanism 30 is coupled to an extension 162 on the intermediate lever 134. When the engine 10 is warm, the mechanism 30 will cause rotation of the intermediate lever 134, which, in turn, holds the choke lever 20 (and thus the choke valve 18) in at least a partially open position to prevent over-enriching of the carburetor 154. In other embodiments, the mechanism 30 contacts a post 166 on the choke lever 20 to hold the choke open.

Figure 15:
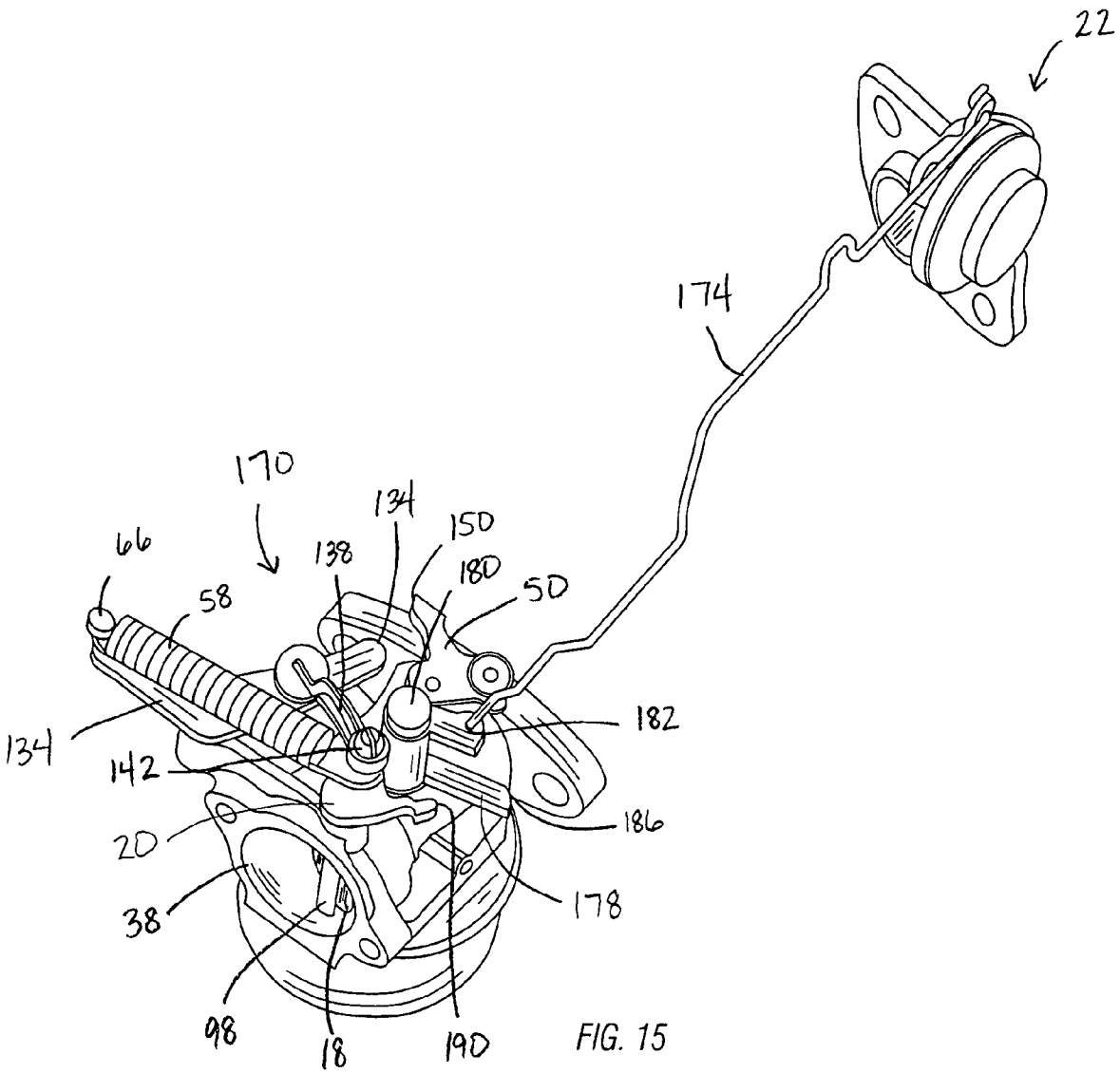
FIG. 15 is a perspective view of another carburetor according to one embodiment of the present invention, illustrating the choke assembly in the closed position and the throttle assembly in the wide open throttle position.
Figure 16:
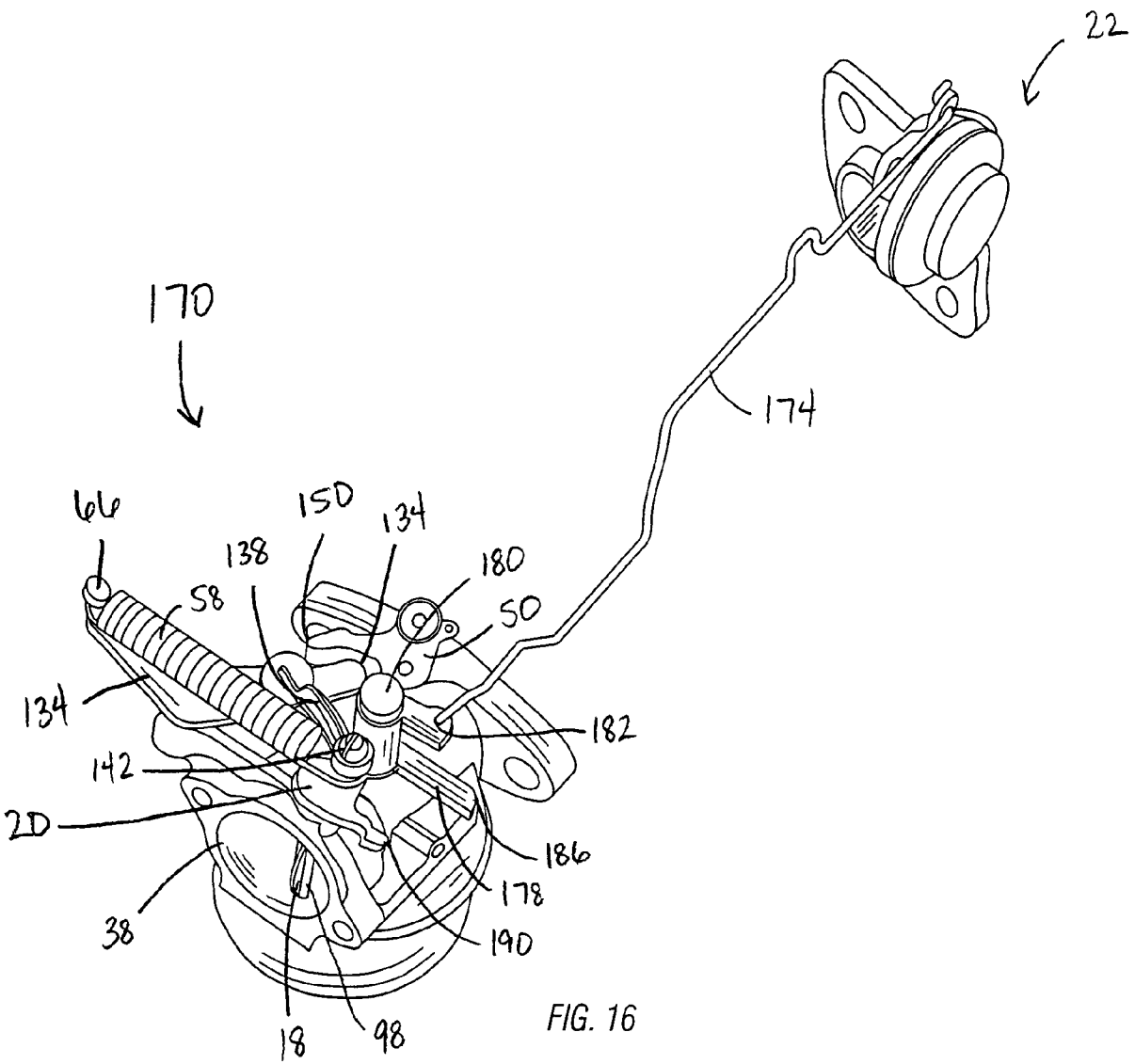
FIG. 16 is a perspective view of the carburetor of FIG. 15, illustrating the choke assembly in the partially open position and the throttle assembly in the high speed no load position.
Figure 17:
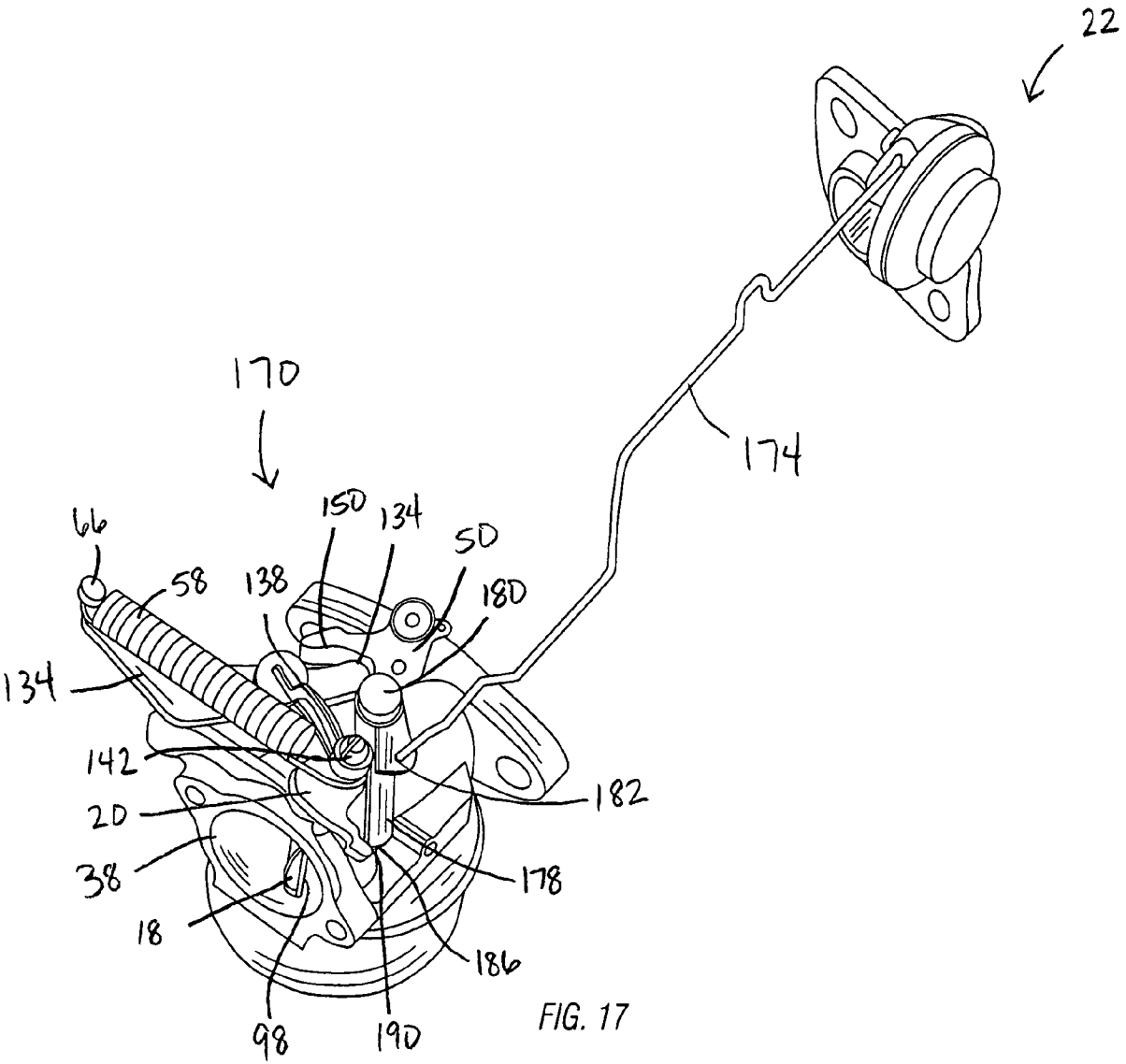
FIG. 17 is a perspective view of the carburetor of FIG. 15, illustrating the choke assembly in the open position and the throttle assembly in the high speed no load position.

FIGS. 15–17 illustrate another carburetor 170 embodying aspects of the present invention. In operation, the carburetor 170 is similar to the carburetor 130 discussed above. As in the embodiment illustrated in FIG. 11 (i.e., the carburetor 130), the choke lever 20 is coupled to the intermediate lever 134 via the connecting link 138. The connecting link 138 is coupled to the connecting post 142 on the choke lever 20 for movement therewith. The connecting link 138 is coupled at the other end to the intermediate lever 134 through an aperture 146. The positions of the connecting post 142 and the aperture 146 are variable. Varying either of the positions of the connecting post 142 and the aperture 146 calibrate operating characteristics within the engine, such as changing the effective spring rate.

The spring 58 is coupled on one end to the spring anchor post 66 and on the other end to the connecting post 142. The intermediate lever 134 also includes a throttle engagement surface 148 that engages a projection 150 on the throttle lever 50 as the throttle lever 50 rotates toward the high speed no load position. The shape and position of the throttle engagement surface 148 and the projection 150 can be varied, which also calibrates operating characteristics within the engine, such as changing the angle of the force applied (as discussed in detail above).

The thermally responsive assembly 22 includes a mechanism 174 that contacts a choke retaining lever 178 to hold the choke open during warm engine restarts. The choke retaining lever 178 is pivotable about post 180. The mechanism 174 is coupled to an aperture 182 in the choke retaining lever 178 such that movement of the mechanism 174 due to changes in engine temperatures results in movement of the choke retaining lever 178.

The choke retaining lever 178 includes a cam member 186 that is engageable with the choke lever 20 to hold the choke open. The choke lever 20 includes a cam surface 190 that interacts with the cam member 186 as the choke retaining lever 178 rotates with movement of the mechanism 174.

During operation of the engine 10, the mechanism 174 of the thermally responsive assembly 22 moves with rising temperatures in the engine 10. The movement of the mechanism 174 causes rotation of the choke retaining lever 178. At the same time, the choke valve 18 moves from the closed position (see FIG. 15) to the partially open position (see FIG. 16) due to the influx of air through the intake passage 38 and the warm-up of the engine 10. As the choke retaining lever 178 rotates toward the choke lever 20, the cam member 186 on the choke retaining lever 178 cams against the cam surface 190 on the choke lever 20, to move the choke 18 to the fully opened position (see FIG. 17). The interaction between the cam member 186 and cam surface 190 also functions to hold the choke 18 at least partially open during warm engine restarts.

Various features of the invention are set forth in the following claims.

We claim:

1. An internal combustion engine, comprising:

a carburetor;

a choke valve disposed within the carburetor;

a choke lever coupled to the choke valve, the choke lever configured to move with the choke valve;

a throttle valve disposed within the carburetor;

a throttle lever coupled to the throttle valve, the throttle lever configured to move with the throttle valve;

an intermediate lever coupled to the carburetor, the intermediate lever configured to engage the choke lever such that movement of the choke lever is translated into movement of the intermediate lever;

a thermally conductive assembly including a mechanism configured to move in response to an exhaust temperature of the engine; and a cam member configured to engage the choke lever to hold the choke valve open in response to movement of the mechanism.

2. The internal combustion engine of claim 1, wherein the cam member is configured to engage a cam surface of the choke lever to move the choke valve toward an open position.

3. The internal combustion engine of claim 1, wherein the cam member is configured to engage a cam surface to hold the choke valve open.

4. The internal combustion engine of claim 1, wherein the cam member is configured to move in response to movement of the mechanism to hold the choke valve open during warm engine restarts.

5. The internal combustion engine of claim 1, wherein the cam member is disposed on a choke retaining lever coupled to the carburetor, and wherein the choke retaining lever is configured to move in response to movement of the mechanism to engage the cam member with the choke lever.

6. The internal combustion engine of claim 5, wherein the mechanism is configured to contact the choke retaining lever to engage the cam member with the choke lever.

7. The internal combustion engine of claim 6, wherein the choke lever includes a cam surface, and wherein the choke retaining lever is configured such that movement of the choke retaining lever results in interaction between the cam surface and the cam member.

8. The internal combustion engine of claim 1, wherein the throttle valve includes an open position and a closed position, wherein the choke valve includes an open position and a closed position, and wherein the throttle lever is configured to engage the choke lever such that movement of the throttle valve toward the closed position upon startup of the engine is configured to translate into movement of the choke valve toward the open position.

9. The internal combustion engine of claim 8, wherein a biasing member is coupled to the choke lever to bias the choke valve toward the closed position, and wherein the throttle lever is configured to engage the intermediate lever in response to movement of the throttle valve toward the closed position to counteract the bias of the biasing member and to move the choke valve toward the open position.

10. The internal combustion engine of claim 9, wherein the throttle lever includes a projection configured to engage a throttle engagement surface disposed on the intermediate lever, and wherein at least one of the shape and position of the throttle engagement surface is configured to be variable to change an operating characteristic of the engine.

11. The internal combustion engine of claim 1, further comprising a connecting link coupled between the choke lever and the intermediate lever, wherein the connecting link is configured to move with movement of the intermediate lever such that movement of the choke lever is translated into some movement of the intermediate lever.

12. The internal combustion engine of claim 1, wherein the choke lever is configured such that a first degree of movement of the choke lever is configured to translate into a second degree of movement of the intermediate lever, wherein the second degree of movement is less than the first degree of movement.

13. The internal combustion engine of claim 12, wherein the choke lever is configured such that four degrees of movement of the choke lever is configured to translate into one degree of movement of the intermediate lever.

14. The internal combustion engine of claim 11, wherein the connecting link is coupled to a connecting post on the choke lever on one end and coupled to an aperture in the intermediate lever at an opposite end, and wherein the position of at least one of the connecting post and the aperture is configured to be variable to change an operating characteristic of the engine.

15. The internal combustion engine of claim 1, wherein a biasing member is coupled between the choke lever and the intermediate lever, and wherein the biasing member is configured to retain the choke valve in at least one of an open and a closed position.

16. The internal combustion engine of claim 15, wherein the biasing member is configured to bias the choke valve in the closed position upon engine startup, and wherein the biasing member is configured to bias the choke valve in the open position after engine warm-up.

17. The internal combustion engine of claim 1, wherein the choke valve is a self-relieving choke.

18. A method of operating a choke of an internal combustion engine that includes a carburetor having a choke valve and a throttle valve, a choke lever attached to the choke valve, and a throttle lever attached to the throttle valve, the method comprising:

providing an intermediate lever;

providing a choke retaining lever including a cam member;

providing a thermally conductive assembly including a mechanism;

moving the throttle valve from an open position toward a closed position in response to startup of the engine;

sensing an engine temperature by exposing the thermally conductive assembly to an exhaust temperature;

moving the mechanism in response to the exhaust temperature; and moving the choke valve from a closed position to an open position in response to movement of the mechanism.

19. The method of claim 18, further comprising engaging the cam member with the choke lever in response to movement of the mechanism; and holding the choke valve open using the cam member.

20. The method of claim 19, wherein the engaging step includes engaging the cam member with a cam surface of the choke lever.

21. The method of claim 19, wherein the engaging step includes engaging the mechanism with the choke retaining lever; and rotating the choke retaining lever.

22. The method of claim 21, wherein the engaging the mechanism step includes contacting the choke retaining lever with the mechanism.

23. The method of claim 19, wherein the holding step includes holding the choke valve at least partially open during warm engine restarts.

24. The method of claim 18, wherein the moving the choke valve step includes biasing the choke valve to a closed position upon startup of the engine;

engaging the throttle lever with the intermediate lever in response to movement of the throttle valve to the closed position;

engaging the intermediate lever with the choke lever in response to engagement of the throttle lever with the intermediate lever; and overcoming the bias of the choke valve to the closed position in response to engagement of the intermediate lever with the choke lever.

25. The method of claim 18, further comprising biasing the choke valve to a closed position upon startup of the engine; and biasing the choke valve to at least a partially open position after the engine is warmed up.

26. The method of claim 18, further comprising moving the choke valve from a closed position to a partially open position;

rotating the choke retaining lever in response to movement of the mechanism; and moving the choke valve to a fully opened position in response to rotation of the choke retaining lever.

27. The method of claim 18, further comprising moving the choke lever through a first degree of movement;

translating the first degree of movement of the choke lever into movement of the intermediate lever; and moving the intermediate lever through a second degree of movement that is less than the first degree of movement in response to the first degree of movement of the choke lever.

28. The method of claim 27, wherein the moving the choke lever step includes moving the choke lever through four degrees of movement, and wherein the moving the intermediate lever step includes moving the intermediate lever through one degree of movement.

29. The method of claim 18, further comprising engaging the intermediate lever with the choke lever;

controlling an opening rate of the choke valve in response to engagement of the intermediate lever with the choke lever;

engaging the throttle lever with the intermediate lever;

rotating the throttle lever toward a high speed no load position; and controlling a speed change in the engine in response to engagement of the throttle lever with the intermediate lever.

* * * * *